US005718130A

United States Patent [19]

Kim

[11] Patent Number: 5,718,130

[45] Date of Patent: Feb. 17, 1998

[54] WASHING/DRYING MACHINE

[75] Inventor: Hong-Kwon Kim, Kwangju, Rep. of Korea

[73] Assignee: Daewoo Electronics Co., Ltd., Seoul, Rep. of Korea

[21] Appl. No.: 771,913

[22] Filed: Dec. 23, 1996

[30] Foreign Application Priority Data

Dec. 30, 1995 [KR] Rep. of Korea ..... 1995-54590

[51] Int. Cl.[6] ..... D06F 25/00

[52] U.S. Cl. ..... 68/19.2; 68/183; 68/207

[58] Field of Search ..... 68/19.2, 20, 19.1, 68/183, 207, 16, 15

[56] References Cited

U.S. PATENT DOCUMENTS

| | | | |
|---|---|---|---|
| 2,574,798 | 11/1951 | Rasmussen | 68/19.2 |
| 2,620,644 | 12/1952 | Rasmussen | 68/183 |
| 3,203,013 | 8/1965 | Buss | 68/19.2 |
| 3,531,954 | 10/1970 | Krupsky | 68/19.2 |
| 3,568,476 | 3/1971 | Seyler | 68/19.2 |
| 4,757,699 | 7/1988 | Arreghini et al. | 68/16 |
| 4,941,333 | 7/1990 | Blessing | 68/207 |
| 5,029,458 | 7/1991 | Obata et al. | 68/207 |
| 5,074,131 | 12/1991 | Hirose et al. | 68/19.2 |
| 5,111,673 | 5/1992 | Kadoya et al. | 68/19.2 |
| 5,457,969 | 10/1995 | Roaf | 68/19.2 |

FOREIGN PATENT DOCUMENTS

| | | | |
|---|---|---|---|
| 0 390 011 | 10/1990 | European Pat. Off. . | |
| 2148127 | 3/1973 | Germany | 68/19.2 |
| 2075559 | 4/1981 | United Kingdom | 68/19.2 |

*Primary Examiner*—Amy B. Vanatta

[57] ABSTRACT

Disclosed is a washing/drying machine which can upwardly blow heated air from a bottom of a spin tub to articles placed in the spin tub, thereby improving a drying effect. The washing/drying machine has a housing and an upper frame mounted on an upper portion of the housing. An outer tub for receiving a washing liquid is disposed in the housing. A spin tub, in which an article to be washed is placed, is accommodated in the outer tub. A pulsator for generating a liquid flow in the spin tub is mounted on a lower portion of the spin tub. An air guide, for guiding heated air towards a bottom wall of the outer tub, is attached to an inside wall of the upper frame. The air guide has a blower and a heater therein. A blowing fan is mounted on the lower portion of the spin tub so as to blow out the heated air towards the side wall of spin tub. An air guiding plate is disposed above the blowing fan so as to guide the heated air into the article in the spin tub. The washing/drying machine reduces an energy loss and improves the drying effect. The washing/drying machine generates a strong liquid flow in the spin tub, thereby improving the washing effect.

15 Claims, 3 Drawing Sheets

WASHING/DRYING MACHINE

BACKGROUND OF THE INVENTION

1. Field of the Invention

The present invention relates to a washing/drying machine, and more particularly to a washing/drying machine which can upwardly blow a heated air from a bottom of a spin tub to articles placed in the spin tub, thereby improving a drying effect.

2. Prior Arts

As is well known, a washing machine is an appliance for separating dirt from articles to be washed such as clothing by sequentially carrying out various cycles in the order of liquid feeding, washing, rinsing, dehydrating, and draining cycles.

Generally, the washing machine has an outer tub for receiving a washing liquid, has a spin tub accommodated in the outer tub, and has a pulsator rotatably mounted on a bottom wall of the spin tub.

While the washing cycle is being executed, the pulsator, which is driven by a motor, generates a swirl-shaped liquid in the spin tub, so the articles which are placed in the spin tub are washed by means of friction between the swirl-shaped liquid flow and the articles.

In addition, while the dehydrating cycle is being executed, the motor rotates the spin tub, so the articles are forced towards a side wall of the spin tub due to a centrifugal force. Accordingly, the washing liquid contained in the articles is drained out of the washing machine through discharging holes which are formed in the side wall of the spin tub.

Recently, washing machines which can not only wash the articles, but also dry the articles have been suggested. These kinds of washing machines, which are called washing/drying machines, can reduce a drying time and do not require a separate space for drying the articles.

FIG. 3 shows one washing/drying machine.

As shown in FIG. 3, a conventional washing/drying machine 500 includes a housing 510 and an upper frame 505 mounted on an upper portion of housing 510. An outer tub 520 for receiving a washing liquid is disposed in housing 510. Enclosed within outer tub 520 is a spin tub 530 which is formed at its side wall with a plurality of discharging holes 532. Below outer tub 520, but within housing 510, there are provided a motor 540 for generating a driving force, and a gear assembly 550 which transfers the driving force of motor 540 to spin tub 530, or to a pulsator 560 rotatably mounted on a bottom wall of spin tub 530. Motor 540 is connected to gear assembly 550 through a belt 544. In addition, a pulsator rotating shaft 584, which is connected to an upper portion of gear assembly 550, is fixedly coupled to a center of an under surface of pulsator 560.

A spraying nozzle assembly 300 for spraying the washing liquid into spin tub 530 is mounted on an upper portion of outer tub 520. Installed at a bottom wall of housing 510 is a circulation pump 570 which is connected to outer tub 520 in order to circulate the washing liquid into spraying nozzle assembly 300, or in order to drain the washing liquid through drain tube 574 out of washing/drying machine 500.

Circulation pump 570 is connected both outer tub 520 and to spraying nozzle assembly 300 through a discharging tube 572 and a circulation tube 576, respectively.

An air guide 400 for guiding an air from an exterior into an interior of washing/drying machine 500 is installed at an inner wall of upper frame 505. A first end of air guide 400 is formed with an air inlet 410, into which the air is introduced, and a second end of air guide 400 is formed with an air outlet 420 through which the air is exhausted into spin tub 530. In order to exhaust the air into spin tub 530, air guide 400 extends towards spin tub 530 by a predetermined length from the side wall of upper frame 505.

In addition, a blower 430 for blowing the air and a heater 440 for heating the air are disposed in air guide 400. At a predetermined position in upper frame 505, there is provided an exhaust hole (not shown) for exhausting the heated air.

Washing/drying machine 500 having the construction as described above operates as follows.

Firstly, when a user pushes an operating switch 507 installed on upper frame 505, the washing liquid is introduced from a liquid source into outer tub 520 until a liquid level in outer tub 520 reaches a predetermined level.

Then, when the liquid level in outer tub 520 reaches the predetermined liquid level, a liquid feed control valve (not shown) blocks a liquid feeding pipe, so the washing liquid stops being supplied into outer tub 520. At the same time, motor 540 rotates in the forward and reverse directions. The rotational force of motor 540 is transmitted to pulsator 560 by way of belt 544, gear assembly 550, and pulsator rotating shaft 584. As a result, pulsator 560 rotates in the forward and reverse directions, thereby washing the articles.

At the same time, an operating signal is transmitted to a pump motor accommodated in circulation pump 570 in accordance with a predetermined algorithm so that the pump motor rotates in the forward direction. When the pump motor rotates in the forward direction, a first valve disposed between circulation pump 570 and circulation tube 576 is opened and a second valve disposed between circulation pump 570 and drain tube 574 is closed. In addition, as the pump motor operates, circulation pump 570 also operates, so some of the washing liquid that has been introduced into outer tub 520 is discharged from outer tub 520 into circulation pump 570 through discharging tube 572.

Upon receiving the washing liquid, circulation pump 570 compresses the washing liquid and circulates the washing liquid through circulation tube 576 into spraying nozzle assembly 300 mounted on the upper portion of outer tub 520. Spraying nozzle assembly 300 strongly sprays the compressed washing liquid onto the articles, so the washing efficiency is improved without wasting any washing liquid.

When the washing cycle has finished, the pump motor rotates in the reverse direction. At this time, the first valve disposed between circulation pump 570 and circulation tube 576 is closed, and the second valve disposed between circulation pump 570 and drain tube 574 is opened. Accordingly, the washing liquid filled in outer tub 520 is drained out of washing/drying machine 500 by way of discharging tube 572, circulation pump 570, and drain tube 574. Then, the dehydrating cycle begins. While the dehydrating cycle is being executed, the washing liquid contained in the articles is drained out of washing/drying machine 500.

When the dehydrating cycle has finished, a microcomputer accommodated in washing/drying machine 500 sends operating signals to blower 430 and heater 440 disposed within air guide 400. As a result, the air is introduced into air guide 400 through air inlet 410 from the exterior of washing/drying machine 500.

The air which has been introduced into air guide 400 is heated while it passes through heater 440, and the heated air exhausts towards spin tub 530 through air outlet 420. At this time, since the second end of air guide 400 extends toward spin tub 530 by the predetermined length, the heated air can exhaust towards the articles placed in spin tub 530, thereby drying the articles.

However, since conventional washing/drying machine 500 directly exhausts the heated air onto the articles from the upper portion of spin tub 530, the drying efficiency is reduced.

Theoretically, particles of the air become more active when the air is heated. Therefore, the heated air has a low particle-density when compared with a particle-density of a peripheral air, so the heated air rises upwards. Accordingly, the heated air which is exhausted from the upper portion of spin tub 530 may not sufficiently make contact with the articles placed in spin tub 530, but drain out of washing/drying machine 500 through the exhaust hole formed at the upper portion of washing/drying machine 500. For this reason, the drying efficiency of conventional washing/drying machine 500 is reduced.

On the other hand, U.S. Pat. No. 4,757,699 issued to Arreghini et al. discloses a washing/drying machine which blows a heated air onto the articles by circulating the air to be heated. However, Arreghini's washing/drying machine also blows the heated air onto the articles from the upper portion of the washing/drying machine, so the drying efficiency is reduced.

SUMMARY OF THE INVENTION

The present invention has been made to overcome the above described problems of the prior arts, and accordingly, it is an object of the present invention to provide a washing/drying machine which guides a heated air from an exterior to a bottom of a spin, and then upwardly blows the heated air from the bottom of the spin tub to articles placed in the spin tub, thereby improving a drying effect.

To achieve the above object, the present invention provides a washing/drying machine comprising:

- a housing;
- an upper frame mounted on an upper portion of the housing;
- an outer tub for receiving a washing liquid, the outer tub being disposed in the housing;
- a spin tub in which an article to be washed is placed, the spin tub being accommodated in the outer tub;
- a pulsator for generating a liquid flow in the spin tub;
- a pulsator driving section for driving the pulsator;
- a first means for guiding a heated air towards a bottom wall of the outer tub, the first means sucking an air from an exterior of the washing/drying machine and then heating the sucked air;
- a second means for blowing the heated air, which is guided by the first means, towards a side wall of the spin tub; and
- a third means for guiding the heated air, which is blown by the second means, towards the article placed in the spin tub.

According to a preferred embodiment of the present invention, the first means includes an air guide attached to a predetermined position in an inside wall of the upper frame, includes a blower disposed in the air guide in order to suck in and blow out the air, and includes a heater disposed in the air guide so as to heat the air which has blown by the blower.

The pulsator driving section includes a motor for generating a rotational force, includes a pulsator driving shaft fixedly coupled to a center of the pulsator, and includes a gear assembly for transferring the rotational force of the motor to the pulsator driving shaft.

The second means includes a blowing fan fixedly coupled to the pulsator driving shaft. The blowing fan has a plurality of blades for sucking and blowing the heated air, and is formed at a top thereof with a cover plate so that the heated air blown by the blowing fan is guided in a lateral direction.

The third means includes an air guiding plate disposed at a lower portion of the spin tub. The air guiding plate is formed with a plurality of air guiding holes. The air guiding plate is formed at a lower portion thereof with an annular groove which is communicated with the air guiding holes so as to guide the heated air into the article placed in the spin tub. The air guiding plate is formed at a center thereof with an annular recess. The pulsator is rotatably accommodated within the annular recess.

The washing/drying machine having the construction as described above operates as follows.

Firstly, when a user pushes an operating switch, the washing liquid is introduced from a liquid source into the outer tub until a liquid level in the outer tub reaches a predetermined level.

Then, when the liquid level in the outer tub reaches the predetermined liquid level, a liquid feed control valve blocks a liquid feeding pipe. At the same time, the motor rotates in the forward and reverse directions. As a result, the pulsator rotates in the forward and reverse directions, thereby washing the articles.

When the washing cycle has finished, the washing liquid filled in the outer tub is drained out of the washing/drying machine. Then, the dehydrating cycle begins. While the dehydrating cycle is being executed, the articles placed in the spin tub are forced towards the side wall of the spin tub due to a centrifugal force applied thereto, so the washing liquid contained in the articles is drained out of the washing/drying machine.

When the dehydrating cycle has finished, a microcomputer accommodated in the washing/drying machine sends operating signals to the blower and the heater disposed within the air guide. At the same time, the microcomputer sends an operating signal to the motor so as to rotate the blowing fan.

As a result, the air is introduced into the air guide from the exterior of the washing/drying machine. The air which has been introduced into the air guide is heated while it passes through the heater, and, the heated air exhausts towards the bottom wall of the outer tub. Then, the heated air is introduced into the spin tub through a perforation hole of the spin tub.

After that, the heated air which has been introduced into the spin tub is blown out towards the side wall of the spin tub by the rotation of the blowing fan. Since the articles are closely adhered to the side wall of the spin tub, the heated air which is blown out towards the side wall of the spin tub can sufficiently make contact with the articles.

As the heated air makes contact with the articles, the liquid contained in the articles evaporates while generating a water vapor, and the water vapor exhausts out of the washing/drying machine through an exhaust hole formed at the predetermined position on the upper frame.

As described above, the washing/drying machine of the present invention can blow the heated air from the bottom of the spin tub to the articles placed in the spin tub, so an energy loss is reduced and the drying effect is improved.

Further, the washing/drying machine of the present invention generates a strong liquid flow in the spin tub while the washing cycle is being executed, thereby improving the washing effect.

BRIEF DESCRIPTION OF THE DRAWINGS

The above objects and other advantages of the present invention will become more apparent by describing in detail a preferred embodiment with reference to the attached drawings, in which.

DESCRIPTION OF THE PREFERRED EMBODIMENTS

Hereinafter, a preferred embodiment of the present invention will be described in detail with reference to the accompanying drawings.

Figure 1:
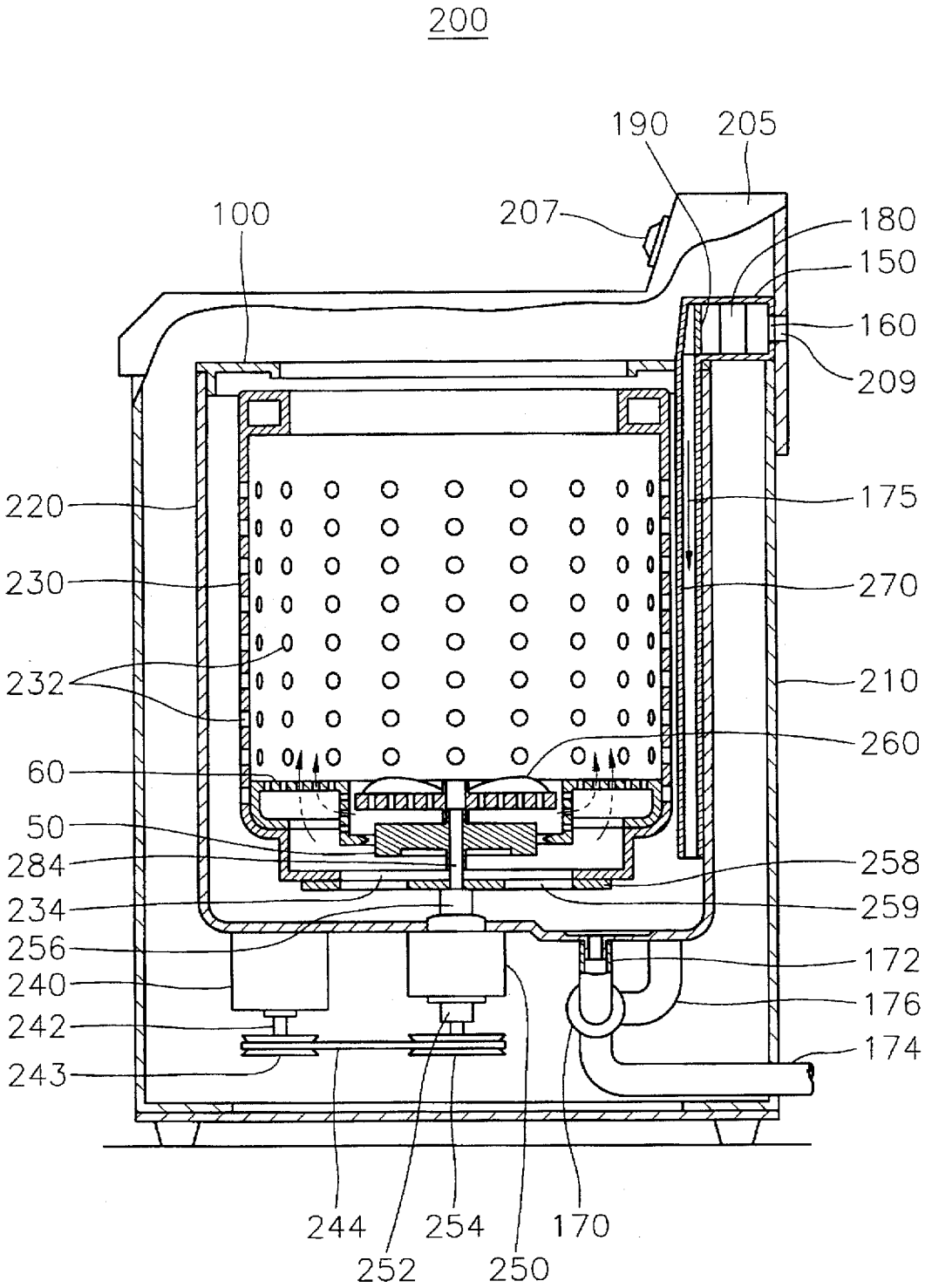
FIG. 1 is a sectional view showing the structure of a washing/drying machine according to one embodiment of the present invention.

FIG. 1 shows a washing/drying machine 200 according to one embodiment of the present invention.

As shown in FIG. 1, washing/drying machine 200 of the present invention includes a housing 210 and an upper frame 205 mounted on an upper portion of housing 210. Upper frame 205 is formed at its side wall with a first air inlet 209 for guiding an air located at the exterior of washing/drying machine 200 into washing/drying machine 200. An outer tub 220 for receiving a washing liquid is disposed in housing 210. Enclosed within outer tub 220 is a spin tub 230 which is formed at its side wall with a plurality of discharging holes 232. In addition, an air guide 150 for guiding the air into the interior of washing/drying machine 200 is attached to a predetermined position on an inside wall of upper frame 205.

Generally, air guide 150 is made of a heat-resistant plastic material and is coupled to the inside wall of upper frame 205 by means of a screw.

A first end of air guide 150 is screw-coupled to the inside wall of upper frame 205, and is formed with a second air inlet 160 which is positioned in a position corresponding to first air inlet 209. In addition, a second end of air guide 150 extends up to a space formed between outer tub 220 and spin tub 230. The second end of air guide 150 is provided with an air port 270 which extends towards a lower portion of outer tub 220 by a predetermined length so as to exhaust a heated air towards a bottom wall of outer tub 220.

Air guide 150 is provided therein with a blower 180, which sucks the air from the exterior of washing/drying machine 200 and then blows the air into the interior of washing/drying machine 200, and a heater 190 for heating the air which has blown by blower 180. Preferably, blower 180 includes a ceramic heater. At a predetermined position in upper frame 205, there is provided an exhaust hole (not shown) for exhausting the heated air.

An air guiding plate 60 is mounted on a lower portion of spin tub 230, and a blowing fan 50 for blowing the heated air towards spin tub 230 is positioned below air guiding plate 60.

Figure 2:
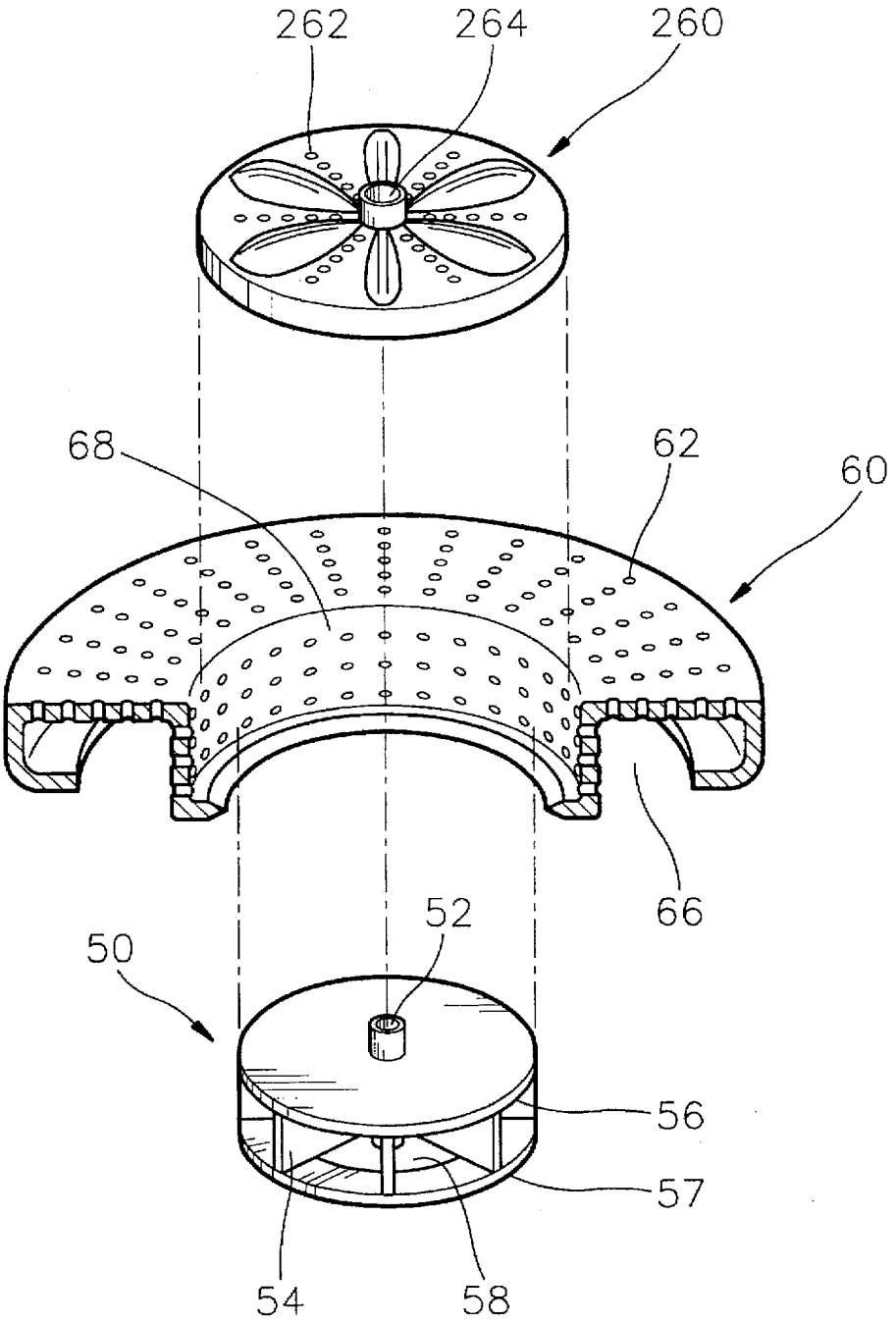
FIG. 2 is an exploded perspective view showing structures of a blowing fan, an air guiding plate, and a pulsator shown in FIG. 1.
Figure 3:
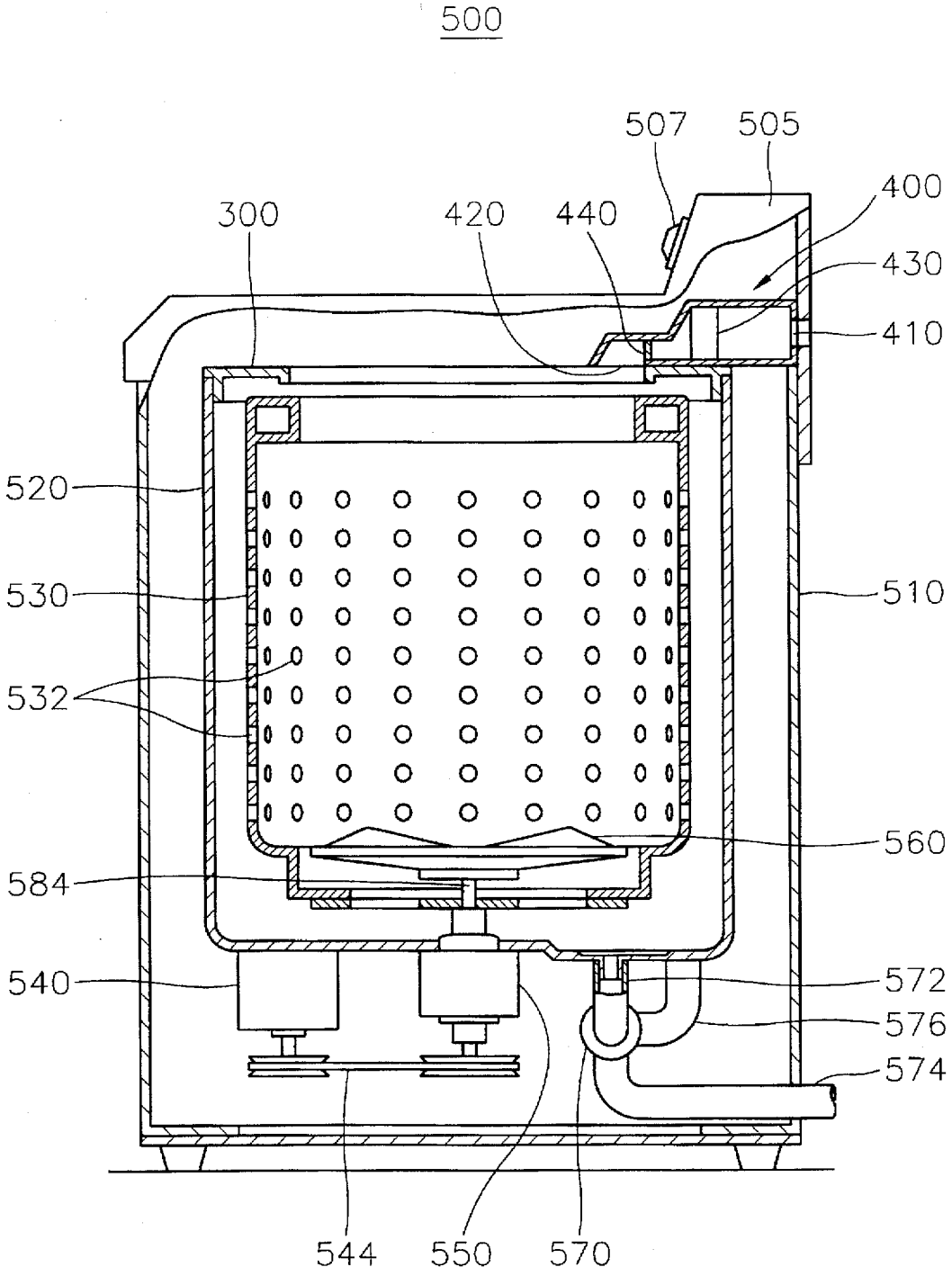
FIG. 3 (PRIOR ART)
FIG. 3 is a sectional view showing the structure of a conventional washing/drying machine.

Referring to FIG. 2, air guiding plate 60 is formed with a plurality of air guiding holes 62, and is formed at a center thereof with an annular recess 68. In addition, an annular groove 66, which is communicated with air guiding holes 62 in order to guide the heated air towards the articles placed in spin tub 230, is formed at a lower portion of air guiding plate 60.

A pulsator 260 is rotatably accommodated within annular recess 68, and is formed at an upper surface thereof with a plurality of bores 262 which guide some of the heated air into a center portion of spin tub 230. Pulsator 260 has a first center hole 264 at a center thereof. In order to permit pulsator 260 to rotate, a diameter of annular recess 68 is larger than an outer diameter of pulsator 260.

Blowing fan 50 has a plurality of blades 54 in order to suck and blow the heated air which has guided by air guide 150. Blowing fan 50 is provided at its top with a cover plate 56, and is provided at its bottom with an annular strip 57 having an air suction hole 58. Blowing fan 50 has a second center hole 52 at a center thereof. Cover plate 56 permits the heated air, which has sucked through air suction hole 58, to blow out towards the side wall of air guiding plate 60.

In addition, disposed below outer tub 220 are a motor 240 for generating a driving force, and a gear assembly 250 which transfers the driving force of motor 240 to spin tub 230 or to pulsator 260.

A spraying nozzle assembly 100 for spraying the washing liquid into spin tub 230 is mounted on an upper portion of outer tub 220. In addition, installed at a bottom wall of housing 210 is a circulation pump 170 which is connected to outer tub 220 in order to circulate the washing liquid into spraying nozzle assembly 100, or in order to drain the washing liquid through a drain tube 174 out of washing/drying machine 200.

Motor 240 has a motor shaft 242 which is formed at its lower end with a first pulley 243. Gear assembly 250 has a rotating shaft 252 which is formed at its lower end with a second pulley 254. Second pulley 254 is connected to first pulley 243 by a belt 244 in such a manner that the rotational force of motor 240 can be transmitted to gear assembly 250.

In addition, a rotating plate 258 is fixedly attached to an under surface of spin tub 230, and a connection member 256, which is fixedly coupled to rotating plate 258, is provided at an upper portion of gear assembly 250. Connected to an upper portion of connection member 256 is a pulsator rotating shaft 284. Pulsator rotating shaft 284 is fixedly inserted into first center hole 264 of pulsator 260 through second center hole 52 of blowing fan 50. In order to guide the heated air into spin tub 230, spin tub 230 is formed at its bottom wall with a perforation hole 234, and rotating plate 258 is formed with an aperture 259 which is communicated with perforation hole 234.

In the washing cycle, gear assembly 250 transfers the rotational force of motor 240 to pulsator 260 through pulsator rotating shaft 284. In the dehydrating cycle, gear assembly 250 transfers the rotational force of motor 240 to spin tub 230 through connection member 256 and rotating plate 258.

In addition, circulation pump 170 has a pump motor (not shown) therein and is connected to outer tub 220 through a discharging tube 172 so as to receive the washing liquid from outer tub 220. Circulation pump 170 is also connected to spraying nozzle assembly 100 through a circulation tube 176 so that the circulated washing liquid is sprayed into spin tub 230.

Washing/drying machine 200 having the construction as described above operates as follows.

Firstly, when a user pushes an operating switch 207 installed on upper frame 205, the washing liquid is introduced from a liquid source into outer tub 220 until a liquid level in outer tub 520 reaches a predetermined level.

Then, when the liquid level in outer tub 220 reaches the predetermined liquid level, a liquid feed control valve (not shown) blocks a liquid feeding pipe, so the washing liquid stops being supplied to outer tub 220. At the same time, motor 240 rotates in the forward and reverse directions. The rotational force of motor 240 is transmitted to pulsator 260 by way of motor shaft 242, first pulley 243, belt 244, second pulley 254, gear assembly 250, and pulsator rotating shaft 284. As a result, pulsator 260 rotates in the forward and reverse directions, thereby washing the articles. At this time, blowing fan 50 which is coupled to pulsator rotating shaft 284 also rotates together with pulsator 260, thereby a strong liquid flow is created in spin tub 230.

At the same time, an operating signal is transmitted to the pump motor accommodated in circulation pump 170 in accordance with a predetermined algorithm so that the pump motor rotates in the forward direction. When the pump motor rotates in the forward direction, a first valve disposed between circulation pump 170 and circulation tube 176 is opened and a second valve disposed between circulation pump 170 and drain tube 174 is closed. In addition, as the pump motor operates, circulation pump 170 also operates, so that some of the washing liquid that has been introduced into outer tub 220 is discharged from outer tub 220 into circulation pump 170 through discharging tube 172.

Upon receiving the washing liquid, circulation pump 170 compresses the washing liquid and circulates the washing liquid through circulation tube 176 into spraying nozzle assembly 100 mounted on the upper portion of outer tub 220. Spraying nozzle assembly 100 strongly sprays the compressed washing liquid onto the articles, so that the washing efficiency is improved without wasting any washing liquid.

When the washing cycle has finished, the pump motor rotates in the reverse direction. At this time, the first valve disposed between circulation pump 170 and circulation pump 176 is closed, and the second valve disposed between circulation pump 170 and drain tube 174 is opened. Accordingly, the washing liquid filled in outer tub 220 is drained out of washing/drying machine 200 by way of discharging tube 172, circulation pump 170, and drain tube 174. Then, the dehydrating cycle begins. While the dehydrating cycle is being executed, the articles placed in spin tub 230 are forced towards the side wall of spin tub 230 due to a centrifugal force applied thereto, so the washing liquid contained in the articles is drained out of washing/drying machine 200 through discharging holes 232.

When the dehydrating cycle has finished, a microcomputer accommodated in washing/drying machine 200 sends operating signals to blower 180 and heater 190 disposed within air guide 150. At the same time, the microcomputer sends an operating signal to motor 240 so as to rotate blowing fan 50. As a result, the air is introduced into air guide 150 from the exterior of washing/drying machine 200 through first air inlet 209 and second air inlet 160.

Then, the air which has been introduced into air guide 150 is heated while it passes through heater 190, and, as shown by an arrow 175 in FIG. 1, the heated air exhausts towards the bottom wall of outer tub 220 through air port 270 which is provided at the second end of air guide 150. Then, the heated air is introduced into spin tub 230 through aperture 259 of rotating plate 258 and through perforation hole 234 of spin tub 230.

After that, the heated air which has been introduced into spin tub 230 is sucked into blowing fan 50 through air suction hole 58 formed at the under side of blowing fan 50 and is blown out towards the side wall of spin tub 230. Accordingly, the heated air passes through annular groove 66 formed at a periphery of air guiding plate 60 and through air guiding holes 62, and thereby makes contact with the articles. As mentioned above, since the articles are closely adhered to the side wall of spin tub 230, the heated air which is blown out towards the side wall of spin tub 230 can sufficiently make contact with the articles.

In addition, since some of the heated air is blown towards the center of spin tub 230 through bores 262 formed in pulsator 260, the heated air can evenly make contact with all of the articles even when some of the articles remain in the center of spin tub 230.

As the heated air makes contact with the articles, the liquid contained in the articles evaporates while generating a water vapor, and the water vapor exhausts out of washing/drying machine 200 through the exhaust hole formed at the predetermined position on upper frame 205.

As described above, the washing/drying machine of the present invention can blow the heated air from the bottom of the spin tub to the articles placed in the spin tub, so an energy loss is reduced and the drying effect is improved.

Further, the washing/drying machine of the present invention generates a strong liquid flow in the spin tub while the washing cycle is being executed, thereby improving the washing effect.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A washing/drying machine comprising:

a housing;

an upper frame mounted on an upper portion of the housing;

an outer tub for receiving a washing liquid, the outer tub being disposed in the housing;

a spin tub in which an article to be washed is placed, the spin tub being accommodated in the outer tub;

a pulsator for generating a liquid flow in the spin tub;

a pulsator driving section for driving the pulsator;

a first means for guiding a heated air towards a bottom wall of the outer tub, the first means sucking an air from an exterior of the washing/drying machine and then heating the sucked air;

a second means for blowing the heated air, which is guided by the first means, towards a side wall of the spin tub; and a third means for guiding the heated air, which is blown by the second means, towards the article placed in the spin tub.

2. The washing/drying machine as claimed in claim 1, wherein the pulsator is disposed in the spin tub and is formed at an upper surface thereof with a plurality of bores.

3. The washing/drying machine as claimed in claim 1, wherein the first means includes an air guide attached to a predetermined position in an inside wall of the upper frame, a blower disposed in the air guide in order to suck in and blow out the air, and a heater disposed in the air guide so as to heat the air which is blown by the blower.

4. The washing/drying machine as claimed in claim 3, wherein the air guide is coupled to the inside wall of the upper frame by means of a screw.

5. The washing/drying machine as claimed in claim 3, wherein the upper frame is formed at the inside wall thereof with a first air inlet, and the air guide has first and second ends, the first end of the air guide being screw-coupled to the inside wall of the upper frame, the second end of the air guide extending up to a space formed between the spin tub and the outer tub, the first end being formed with a second air inlet which is positioned in a position corresponding to the first air inlet, the second end being integrally formed with an air port which extends to a lower portion of the outer tub by a predetermined length.

6. The washing/drying machine as claimed in claim 3, wherein the pulsator driving section includes a motor for generating a rotational force, a pulsator driving shaft fixedly coupled to a center of the pulsator, and a gear assembly for transferring the rotational force of the motor to the pulsator driving shaft.

7. The washing/drying machine as claimed in claim 6, wherein the second means includes a blowing fan fixedly coupled to the pulsator driving shaft, the blowing fan being coaxially disposed below the pulsator.

8. The washing/drying machine as claimed in claim 7, wherein the blowing fan has a plurality of blades for sucking and blowing the heated air, the blowing fan being formed at a top thereof with a cover plate so that the heated air blown by the blowing fan is guided in a lateral direction.

9. The washing/drying machine as claimed in claim 7, wherein the spin tub is formed at a bottom wall thereof with a perforation hole so as to guide the heated air into the spin tub.

10. The washing/drying machine as claimed in claim 9, wherein the blowing fan is disposed above the perforation hole of the spin tub.

11. The washing/drying machine as claimed in claim 7, wherein the third means includes an air guiding plate disposed at a lower portion of the spin tub, the air guiding plate being positioned above the blowing fan, the guiding plate being formed with a plurality of air guiding holes.

12. The washing/drying machine as claimed in claim 11, wherein the air guiding plate is formed at a lower portion thereof with an annular groove which is communicated with the air guiding holes so as to guide the heated air to the article placed in the spin tub.

13. The washing/drying machine as claimed in claim 11, wherein the air guiding plate is formed at a center thereof with an annular recess, the pulsator being rotatably accommodated within the annular recess.

14. The washing/drying machine as claimed in claim 13, wherein the annular recess has a diameter larger than an outer diameter of the pulsator.

15. A washing/drying machine comprising:

a housing;

an upper frame mounted on an upper portion of the housing, the upper frame being formed at an inside wall thereof with a first air inlet;

an outer tub for receiving a washing liquid, the outer tub being disposed in the housing;

a spin tub in which an article to be washed is placed, the spin tub being accommodated in the outer tub, the spin tub being formed at a bottom wall thereof with a perforation hole so as to guide a heated air into the spin tub;

a pulsator for generating a liquid flow in the spin tub, the pulsator being disposed in the spin tub and being formed at an upper surface thereof with a plurality of bores;

a pulsator driving section including a motor for generating a rotational force, a pulsator driving shaft fixedly coupled to a center of the pulsator, and a gear assembly for transferring the rotational force of the motor to the pulsator driving shaft;

an air guide attached to a predetermined position in an inside wall of the upper frame so as to guide the heated air towards a bottom wall of the outer tub, the air guide having first and second ends, the first end of the air guide being screw-coupled to the inside wall of the upper frame, the second end of the air guide extending up to a space formed between the spin tub and the outer tub, the first end being formed with a second air inlet which is positioned in a position corresponding to the first air inlet, the second end being integrally formed with an air port which extends to a lower portion of the outer tub by a predetermined length;

a blower for sucking in and blowing out an air which is guided into the air guide, the blower being disposed in the air guide;

a heater disposed in the air guide so as to heat the air which is blown by the blower;

a blowing fan fixedly coupled to the pulsator driving shaft, the blowing fan being coaxially disposed below the pulsator, the blowing fan having a plurality of blades for sucking and blowing the heated air, the blowing fan being formed at a top thereof with a cover plate so that the heated air blown by the blowing fan is guided in a lateral direction, the blowing fan being disposed above the perforation hole of the spin tub; and an air guiding plate disposed at a lower portion of the spin tub, the air guiding plate being positioned above the blowing fan, the guiding plate being formed with a plurality of air guiding holes, the air guiding plate being formed at a lower portion thereof with an annular groove which is communicated with the air guiding holes so as to guide the heated air to the article in the spin tub, the air guiding plate being formed at a center thereof with an annular recess within which the pulsator is rotatably accommodated, the annular recess having a diameter larger than an outer diameter of the pulsator.

* * * * *